United States Patent [19]

Connor et al.

[11] Patent Number: 4,471,879

[45] Date of Patent: Sep. 18, 1984

[54] METAL OVERCAP FOR PHARMACEUTICAL AND SIMILAR CONTAINERS

[75] Inventors: John T. Connor, Schwenksville; William A. Conard, Norristown; Charles D. Kern, Wayne, all of Pa.; Joe E. Irvin, Petosky, Mich.

[73] Assignee: The West Company, Phoenixville, Pa.

[21] Appl. No.: 520,186

[22] Filed: Aug. 4, 1983

[51] Int. Cl.[3] ..... B65D 51/18

[52] U.S. Cl. ..... 215/249; 215/251; 215/365

[58] Field of Search ..... 215/247, 248, 249, 365, 215/251

[56] References Cited

U.S. PATENT DOCUMENTS

| | | | |
|---|---|---|---|
| 4,205,754 | 6/1980 | Nielsen et al. | 215/249 |
| 4,227,617 | 10/1980 | Albrecht et al. | 215/249 |
| 4,244,478 | 1/1981 | Handman | 215/249 |

*Primary Examiner*—George T. Hall

*Attorney, Agent, or Firm*—Eugene E. Renz, Jr.

[57] ABSTRACT

This invention relates to an overcap for pharmaceutical and similar containers which enables an immediate determination to be made whether or not the container has been tampered with or if an additive has been injected into the containers.

12 Claims, 15 Drawing Figures

10
12

12
10

12
18
20

10
18
20

22
18
20
10

28
7.
22
24
26
7.
26

22
28
30a
9.
9.
30
32
34
32
30
24
26
26
26
8.
8.

26
28
32
30a
34
24
26
32
26
32
26

30a
32
30
32
32
34
32
28

28
22
24
26
18
20
10

28
22
10

14.
28
22
24
20
14.
10

28
36
15.
22
24
10
15.

22
30a
32
30
28
24
26
26
34
20
18
10

38
22
30
24
26
26
20
18
10

METAL OVERCAP FOR PHARMACEUTICAL AND SIMILAR CONTAINERS

BACKGROUND OF THE INVENTION

Pharmaceutical containers for liquids have a pierceable closure member such as a disc or stopper formed of rubber or like material and a metallic cap to hold the stopper in place. Such caps generally have an inner central removable disc detachably secured to the outer annular top portion of the cap by fractionable bridges. For example, by lifting off the center disc portion the stopper area is made available. An alternate system for such caps employs a cover attached to the outer annular portion of the cap and may be removed by pushing the cover off with the thumb (see U.S. Pat. No. 3,071,274). Still another alternative technique is the use of a tear-off cap which provides a hinged central portion at the top of the cap to provide a grip for tearing off the cover over the stopper and around the top of the container. Material is conventionally removed from, and often added to, the container by means of a hypodermic needle and syringe and it is often desired to inject an additive to such containers, particularly those containing intravenous solutions. In such instance, it is necessary, of course, to keep records of what has been added, but the opportunity for the loss of records and ultimate confusion and errors exist.

The present invention provides a simple means to immediately indicate whether or not a solution in a pharmaceutical container has been altered and the user of the solution can also immediately know what has been added to the container. This result is achieved by this invention which provides a protective easily removed over-cap for the altered container which overcap may be color coded or otherwise distinguished to identify the container contents. In addition, the protective over-cap of the invention provides evidence of tampering with the contents of the container when the removable top portion is seen to have been removed.

BRIEF DESCRIPTION OF THE INVENTION

The invention comprises an easily removed overcap which is secured over the cap initially placed on a pharmaceutical container and which has had the stopper exposed, the overcap being distinguished from the first cap by color or other means. The overcap has a top portion which protects the stopper and also is readily removed to make the contents of the container available for further use.

DISCUSSION OF PRIOR ART

Removable caps for pharmaceutical containers covering rubber stoppers in the neck of the container are known. As referred to above, U.S. Pat. No. 3,071,274 discloses a basic type having a cap with a top portion removable by pushing the top with the thumb whereby an inner central disk portion is lifted off to expose the rubber stopper. U.S. Pat. No. 3,547,297 also discloses a cap with a lift up top which is an improvement over that of U.S. Pat. No. 3,071,274 and provides for the central removable disc portion to be connected to the annular top portion of the cap by means of a partial score line so as to enable removal of the top with less effort. U.S. Pat. No. 3,587,897 discloses a similar cap but also having a depending skirt which is adapted to be crimped inwardly at its lower edge over an outer bead finish on the container to hold the stopper or disc in place. All of the above patents are owned by the assignee of the present application which is an improvement over the caps described above.

Techniques alternative to that described by the present invention are available, but have serious problems associated with them. For example, after a conventional cap is removed from a pharmaceutical container, a paper or plastic label may be pasted over the exposed rubber stopper. However, the adhesive on such a label may contaminate the stopper or the label could fall off and expose the stopper to other contamination. Furthermore, the label can be removed and material added to the container without any evidence of such tampering being seen. As will be seen from the description which follows, the present invention overcomes such problems.

DETAILED DESCRIPTION OF THE INVENTION

The invention comprises in combination: (1) a container fitted with a closure comprising a first cap of cup-like form adapted to hold a stopper or liner in place over the container opening and wherein the stopper or liner has been exposed by removal of a cover for the stopper or liner, and (2) an overcap secured over the first cap, having a top construction comprising an annular portion and a removable disc portion disposed centrally of the annular portion, fracturable bridge means connecting the disc and annular portion, a flange depending from the outer peripheral edge of the annular portion adapted to fit over the first cap, the flange having a distinguishing color or markings. The removable disc portion being actuable with respect to the annular portion to break the bridge means and separate the disc portion from the annular portion.

Figures 1, 2, 3, 4, 5, 6, 7, 8, 9:
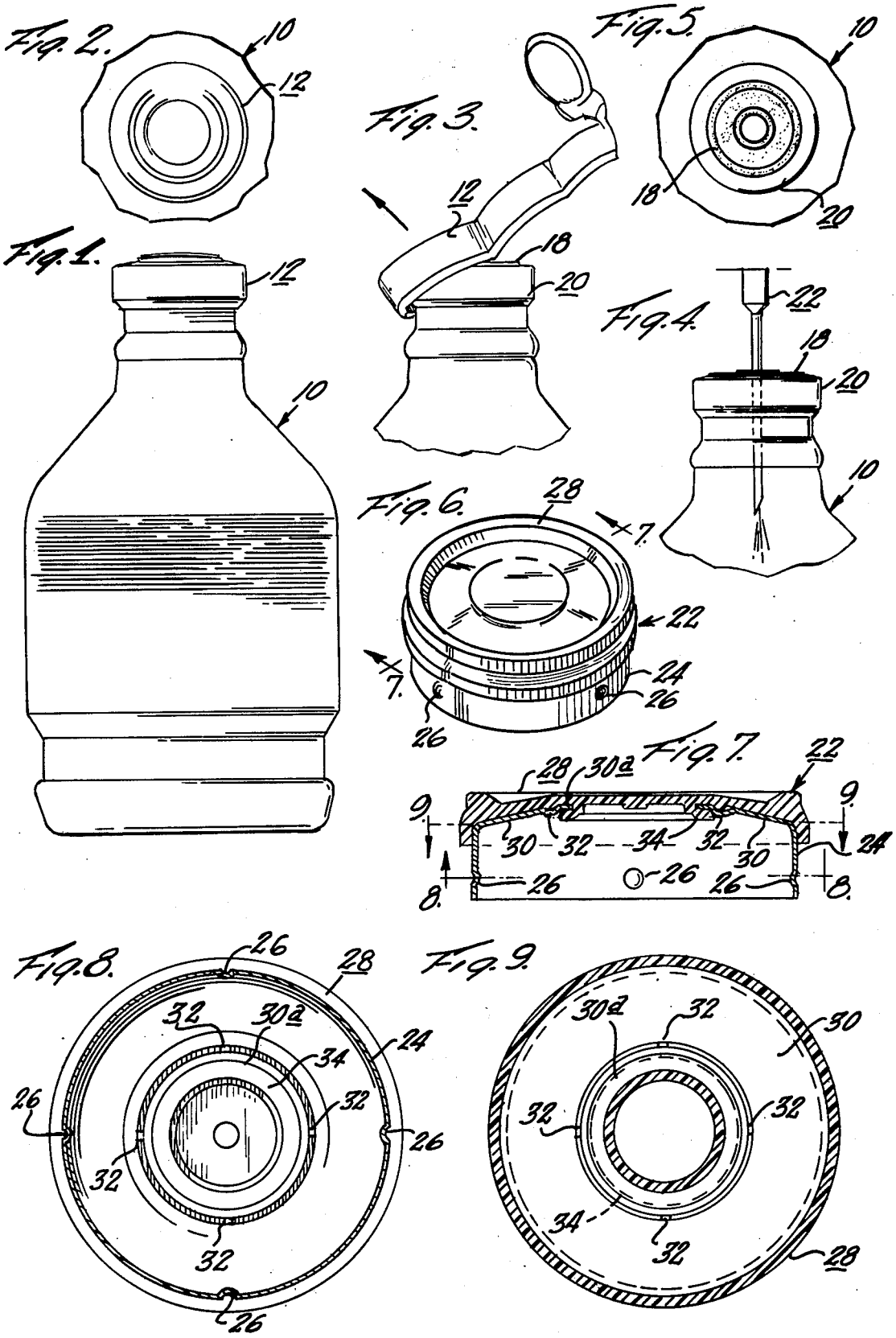
FIG. 1 is a side elevational view of a container with the conventional tear-off cap.
FIG. 2 is a fragmentary plan view of FIG. 1.
FIG. 3 is a side elevational view showing removal of the tear-off cap.
FIG. 4 is a side elevational view to show the introduction of a hypodermic needle through the stopper.
FIG. 5 is a plan view of the cap showing the exposed stopper area on the cap.
FIG. 6 is a perspective view of the overcap of the invention.
FIG. 7 is a sectional elevational view taken along line 7—7 of FIG. 6.
FIG. 8 is an enlarged bottom plan view taken along line 8—8 of FIG. 7.
FIG. 9 is an enlarged plan view taken along line 9—9 of FIG. 7.

Referring now to FIG. 1, a pharmaceutical container (10) is shown with an outer cap or closure (12) secured over its opening. The plan view of FIG. 2 and FIG. 3 shows the conventional outer cap (12) with a tear-off central disc (14) which when pulled removes the outer cap (12) exposing the rubber or similar stopper (18) held in place over the opening by a stopper retaining cap (20), usually made of aluminum. Such an opened container often has additional material added to it by means of a hypodermic syringe (22) shown in FIG. 4.

Now, in accordance with the present invention, means are provided to seal and identify those containers which have added material and this is accomplished with the overcap (22), shown in FIG. 6 and FIG. 7. The overcap (22) has a removable portion shown as numeral 28 and a cap portion comprising a metal band or skirt (24) made of metal or a plastic material with shoulders 30. This skirt or band (24) is colored or otherwise bears distinguishing features for ready identification. For example, the band may bear a colored groove or ring, raised ribs, a series of vertical or horizontal stripes and the like for identification of the contents of the container. The colored band will contain one or more detents (26) to assist the frictional engagement of the skirt 24 of the overcap over the stopper retaining cap (20). These detents are particularly effective when the band is of metal (preferably aluminum) and fitted over its aluminum outer cap originally on the container. The removable portion (28) of the overcap (22) is preferably a thermoplastic material such as polyethylene or polypropylene and is shown in detail in FIG. 7. Alternatively, however, either or both the colored band and the removable portion of the overcap may be made of plastic or metal. As seen in FIG. 7, the removable portion (28) is attached to the shoulder section 30 of the cap be means of fracturable bridges 32. These bridges are created in the manufacturing process for the overcap of the invention by heat molding an inner disc 34, which overlaps the cap portion shoulders shown at 30*a*, to the central portion of the underside of the removable portion of the overcap (22). The top central portion of the overcap may be provided with a roughened or other type of surface adapted to receive pencil or pen markings for notation for further identification of the contents and/or notes of instruction and/or use.

FIG. 8, taken along line 8—8 of FIG. 7 shows in bottom plan view the arrangement of the molded inner disc 34 to the removable portion 28.

FIG. 9, taken along line 9—9 of FIG. 7 shows a top planar view and further clarifies the arrangement of plastic disc 34.

Figure 10:
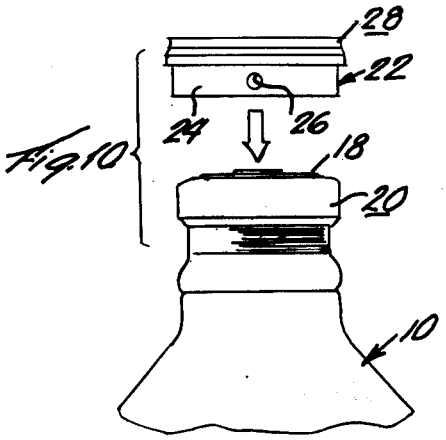
FIG. 10 is a fragmentary, exploded elevational view showing the placement of the overcap over the conventional cap.

FIG. 10 shows how the overcap of the invention is placed on the conventional stopper retaining cap (20) whereby by means of indents (26) the skirt 24 is assured of a tight friction fit.

Figure 11:
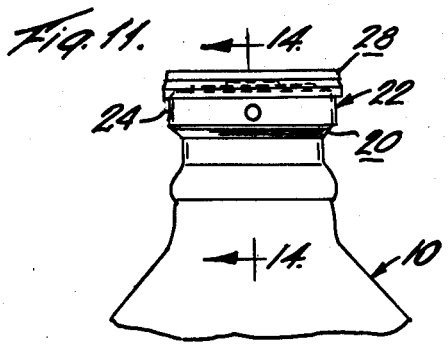
FIG. 11 is a side elevational view showing the overcap positioned on the conventional cap.

FIG. 11 shows the overcap of the invention in position over the conventional closure.

Figure 12:
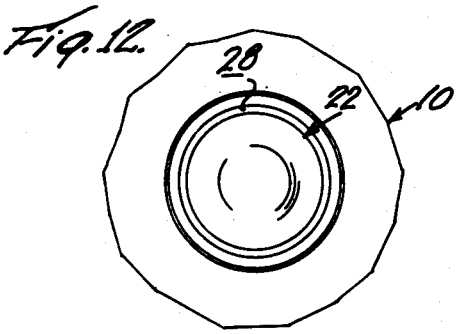
FIG. 12 is a plan view of FIG. 11.

FIG. 12 is a plan view of FIG. 11 showing the overcap (22) covering the rubber stopper 18 prior to use.

Figure 13:
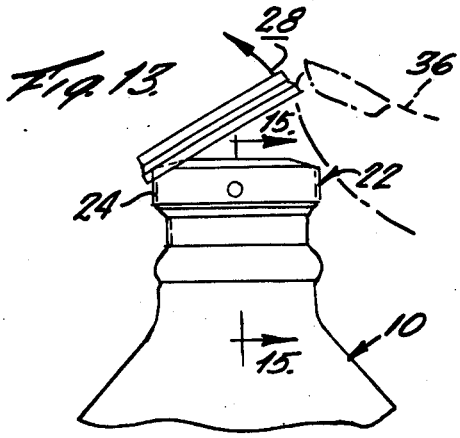
FIG. 13 is a side elevational view showing how the overcap cover may be removed.

FIG. 13 shows removal of the overcap portion 28 by use of a thumb (36) to apply force and thereby break the fracturable bridges which attach the cap portion 28 to the shoulder of the skirt 24. This removal of the overcap may be accomplished by the user with only one hand whereby the hand supports the container and the thumb of the same hand pushes the cap portion (28) upward to break the fracturable bridges. In this way, the rubber stopper is exposed for use while retaining the color coded overcap (24). It should be noted that the fracturable bridges in the overcap are strong enough to withstand application of the overcap to the conventional cap. However, once the overcap is in place on the container, the amount of force to break the fracturable bridges is quite small and thus even slight tampering with the removable cap portion will effect its removal and indicate tampering of the container.

Figure 14:
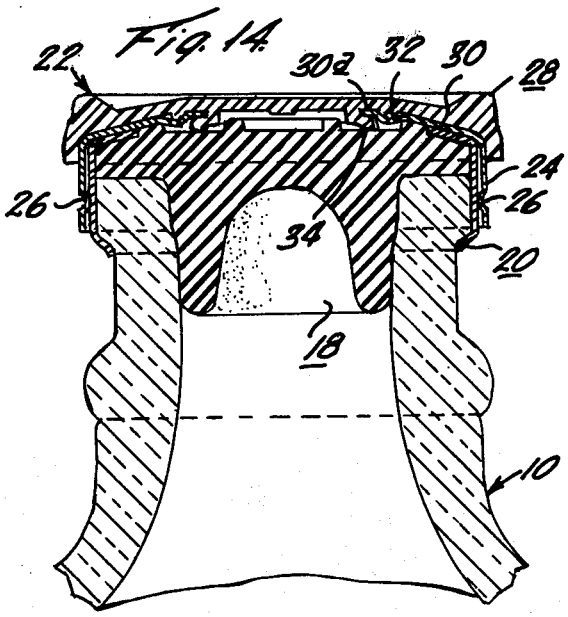
FIG. 14 is an enlarged fragmentary, sectional elevational view taken on line 14—14 of FIG. 11 showing the overcap in detail.

FIG. 14 is taken along line 14—14 of FIG. 11 and shows in enlarged side elevational view the details of the overcap of the invention on the conventional cap which holds stopper 18 in the container.

Figure 15:
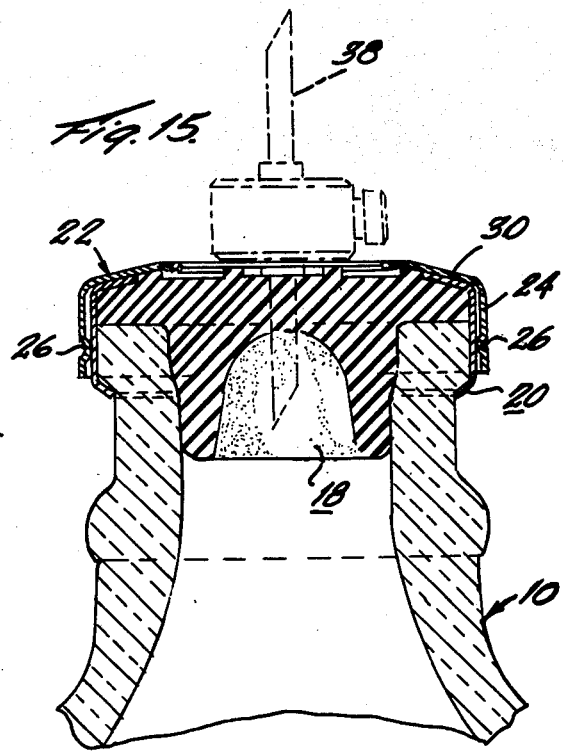
FIG. 15 is an enlarged sectional, side elevational view taken on line 15—15 of FIG. 13 showing the device of the invention in use.

FIG. 15, taken on line 15—15 of FIG. 13 shows the availability of the stopper (18) to access by an I.V. adaptor (38) (shown in phantom line) for connection to tubing for use in intravenous injections and the container's contents will be identified by the colored skirt 24. Further, the fact that the container has been tampered with is indicated by the absence of the removable cap portion (28).

The following discussion will illustrate in further detail how the invention is used and the benefits derived therefrom.

Referring to FIG. 1, a conventional pharmaceutical or medicinal bottle may contain a medicament, plasma, saline solution or the like. For the illustration here, use of a saline solution in such a container will be described.

It is often desired to add a medication, a vitamine solution, an antibiotic and the like to the saline solution in the container. For the purpose of this illustration, it will be assumed that a potassium salt solution is added to the saline solution in order to carry the potassium with the saline solution through the venous system of the patient being treated. The general procedure to accomplish this will be for the pharmacist at the hospital to remove the tear-off central disc (14) from the standard cap (12) of a conventional bottle of saline solution in a standard bottle as shown in FIG. 1. This step exposes the rubber stopper or liner (18) as shown in FIG. 4 and the pharmacist then injects the desired amont of potassium salt solution into the saline solution by use of a hypodermic syringe whose needle is inserted through the rubber stopper or liner. Upon removal of the hypodermic needle, the pharmacist places the overcap (22) over the convention cap (12) and presses the overcap down to make a tight fit which is enhanced by the detents (26). The overcap used by the pharmacist will have a colored skirt and may be selected to correspond to a color code for a potassium salt or there may be no specific relationship between the additive and the color. In either case, however, the colored skirt of the overcap will be an indication that something has been added to the bottle and that it does not contain only saline solution. Preferably, the pharmacist will use an overcap whose central portion is adapted to receive notations and he will note on this part of the overcap that the saline solution bottle contains the potassium additive. The bottle is then passed on to the various personnel in the hospital until it is finally used for the patient, each of the persons involved being able to tell from the colored skirt of the overcap that it contains more than plain saline solution and confirm its contents with the chart for the patient for whoever it is intended. Thus, the possibility of error in treating a patient with the wrong medication is eliminated as, at least, significantly reduced.

Further, if the removable portion and the overcap (28) is not intact on the overcap itself, it is immediately apparent that tampering has occurred, that the contents of the containers are not known with surety, and the container should be discarded.

Assuming that the removable portion (28) of the overcap is intact, the contents of the container are readily accessed by pushing off the removable portion (28) of the overcap by pushing it upwardly with the thumb, whereby it breaks off and removing the contents with a hypodermic syringe or by means of an intravenous adapter being pushed through the stopper and the bottle inverted.

It will also be understood that the overcap of the invention will have application in areas other than hospitals and pharmacies. Chemical, biochemical and diagnostic laboratories also use containers similar to those described herein where the contents are used for chemical reactions and in analytical processes. The overcap of the invention will also find use in such environments.

From the foregoing, it will be apparent that the present invention provides an improvement in cap closures for pharmaceutical bottles or the like which is of tamperproof construction and wherein the removable portion may be readily and easily removed by a one-hand operation. Further the overcap of the present invention provides an effective seal for the container to safeguard the contents of the container from contamination. Additionally the cap is relatively simple in construction and can be manufactured easily and economically. Thus, the overcap described above is a useful tool in medical or pharmaceutical laboratories and makes a valuable contribution to the art.

We claim:

1. In combination, (1) a container fitted with a closure comprising a first cap of cup-like form adapted to hold a stopper or liner in place over said container opening and wherein said stopper or liner has been exposed by removal of a cover for said stopper or liner, and (2) an overcap secured over said first cap, said overcap having a top construction comprising an annular portion and a removable disc portion disposed centrally of said annular portion, fracturable bridge means connecting said disc portion and annular portion, a flange depending from the outer peripheral edge of said annular portion adapted to fit over said first cap, said flange having a distinguishing color or markings, said removable disc portion being actuable with respect to said annular portion to break said bridge means and separate said disc portion from said annular portion.

2. The combination of claim 1 wherein the flange of said overcap has detents to assist frictionable engagement.

3. The combination of claim 2 wherein the flange of said overcap is made of aluminum and the removable disc portion is made of plastic.

4. The combination of claim 3 wherein the removable disc portion is made of polyethylene.

5. In combination, (1) a container fitted with a closure comprising a first cap of cup-like form adapted to hold a stopper or liner in place over said container opening and wherein said stopper or liner has been exposed by removal of a cover for said stopper or liner, and (2) an overcap secured over said first cap, said overcap having a top construction comprising an annular portion and a removable disc portion disposed centrally of said annular portion, fracturable bridge means connecting said disc portion and annular portion, a flange depending from the outer peripheral edge of said annular portion adapted to fit over said first cap, said flange having detents to assist in frictional engagement and having a distinguishing color or markings to distinguish, said removable disc portion being actuable with respect to said annular portion to break said bridge means and separate said disc portion from said annular portion, whereby said depending flange portion acts to identify the contents of the container and the disc portion acts to indicate tampering.

6. The combination of claim 5 wherein the removable disc portion of said overcap is adapted to receive notations.

7. A method of adding an additive to a pharmaceutical container containing a medicament and fitted with a removable top portion of a closure adapted to hold a stopper or liner in place over said container opening, which comprises a. removing said removable closure to expose a stopper or liner protecting said container opening;

b. injecting an additive through said stopper or liner into said container;

c. applying over said stopper or liner an overcap having a top construction comprising an annular portion and a removable disc portion disposed centrally of said annular portion, fracturable bridge means connecting said disc portion and annular portion, a flange depending from the outer peripheral edge of said annular portion adapted to fit over said first cap, said flange having a distinguishing color or markings, said removable disc portion being actuable with respect to said annular portion to break said bridge means and separate said disc portion from said annular portion, whereby such addition is made evident and characterized by said color or markings on said flange and whereby the absence of said removable disc portion is evidence of tampering with said container to which the additive has been made.

8. The method of claim 7 wherein the flange of said overcap has detents to assist frictionable engagement.

9. The method of claim 8 wherein the flange of said overcap is made of aluminum and the removable disc portion is made of plastic.

10. The method of claim 9 wherein the removable disc portion is made of polyethylene.

11. A system for providing visual indicia and evidence of tampering for medicinal containers comprising (1) a container fitted with a closure comprising a first fixed cap of cup-like form adapted to hold a stopper or liner in place over said container opening and wherein said stopper or liner has been exposed by removal of a cover for said stopper or liner, and (2) a second overcap secured over said first cap, said overcap having a top construction comprising an annular portion and a removable disc portion disposed centrally of said annular portion, fracturable bridge means connecting said disc portion and annular portion, a flange depending from the outer peripheral edge of said annular portion adapted to fit over said first cap, said flange having detents to assist in functional engagement and having a distinguishing color or markings, said removable disc portion being actuable with respect to said annular portion to break said bridge means and separate said disc portion from said annular portion, whereby said depending flange portion acts to identify the contents of the container and absence of the disc portion indicates tampering.

12. The combination of claim 11 wherein the removable disc portion of said overcap is adapted to receive notations.

* * * * *